United States Patent [19]

Koontz

[11] Patent Number: 4,484,366

[45] Date of Patent: Nov. 27, 1984

[54] INVALID TRANSFER DEVICE

[76] Inventor: Curtis A. Koontz, 57768 Oakside Ave., Mishawaka, Ind. 46544

[21] Appl. No.: 476,488

[22] Filed: Mar. 18, 1983

[51] Int. Cl.[3] ..... A61G 7/10

[52] U.S. Cl. ..... 5/86; 5/81 R; 212/147

[58] Field of Search ..... 5/81 R, 81 B, 83, 86, 5/87; 212/147; 414/921

[56] References Cited

U.S. PATENT DOCUMENTS 4,443,902 4/1984 Baer ..... 5/86

FOREIGN PATENT DOCUMENTS 218600 3/1958 Australia ..... 5/86

2414909 9/1979 France ..... 5/81 R

*Primary Examiner*—Alexander Grosz

[57] ABSTRACT

An invalid transfer device is provided to carry an individual. The device includes a base with a support assembly extending upwardly from the base. A carrier assembly connects with a control unit via a cable carried by the support assembly and an anti-sway assembly extends between the support assembly and the carrier assembly to retain the latter directly over the base.

14 Claims, 2 Drawing Figures

INVALID TRANSFER DEVICE

This invention relates to an invalid transfer device wherein an individual can control the operation of the device while at the same time be carried by the device.

In the past a wheel chair has been proposed as a means of transport for moving an individual who is an invalid. The wheel chair is electrically powered by batteries and a control coupled to the batteries is operable upon an input from the individual operator to impart motion and direction to the wheel chair. Although providing some independence for the individual in moving about, there is no provision for getting into and out of the wheel chair. Consequently, assistance is generally required before the individual can operate the wheel chair.

Various other devices have been proposed which transport an individual from place to place. However, these devices require that the individual receive assistance from a third party before the indivudual can be disposed on the device, and also when the individial wants to dismount from the device. Examples of these devices can be found in U.S. Pat. Nos. 4,255,823; 4,119,164; 4,117,561; 3,999,228; 3,807,520; 3,469,269; 3,189,345; 3,137,869; 3,112,001; 2,991,485; and 578,368.

In addition, when an individual is operating a transfer device it is important that the device operate smoothly and carry the individual in a stable position. An unforseen dismount from the device during operation could seriously injure the individual or prevent the individual from reaching his destination.

The present invention provides an improvement over the devices in the above-mentioned patents. In particular, the present invention enables an individual to independently position himself or herself on the transfer device without requiring the individual to stand up. The transfer device includes a wide range of vertical positions for the individual so that transfer to and from a bed, chair, floor or commode is easily undertaken with the transfer device of the present invention. And finally, the transfer device provides an anti-sway assembly to substantially eliminate instability during operation so that the individual is smoothly carried on the transfer device.

It is an object of the present invention to provide a simple structure which provides movement for an invalid in a safe manner while at the same time enabling the invalid to position himself or herself in a multiplicity of positions in the absence of assistance from a third party.

Figure 1:
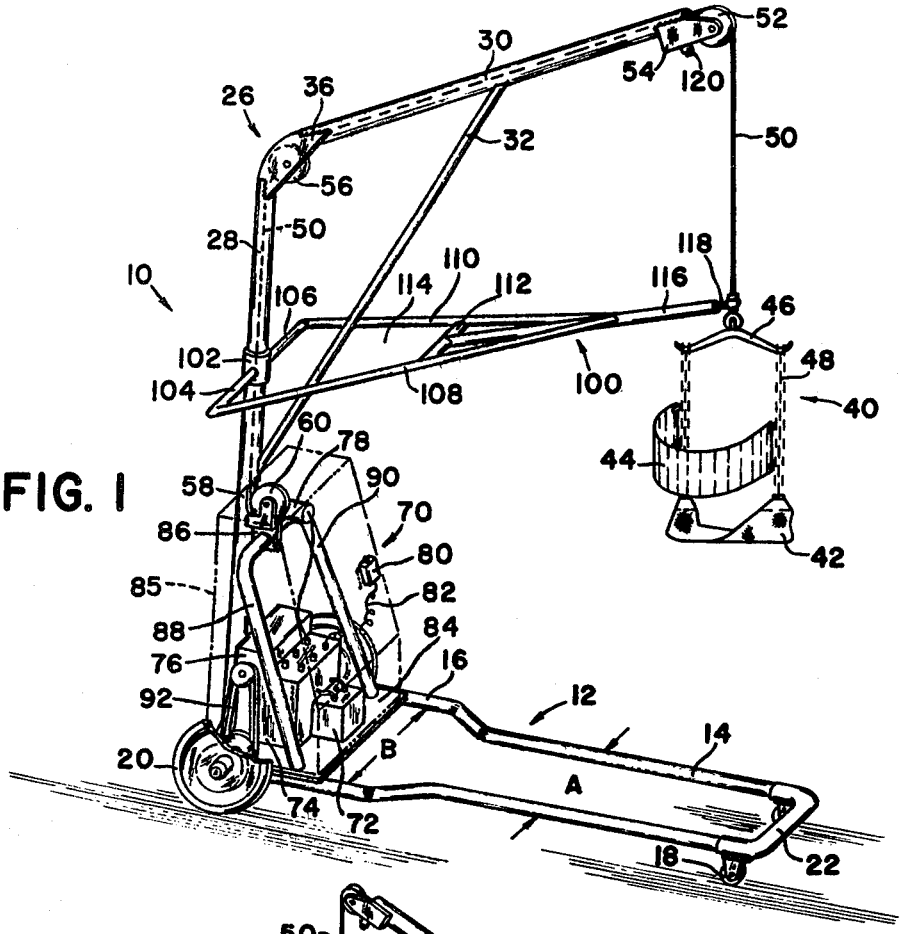
Figure 2:
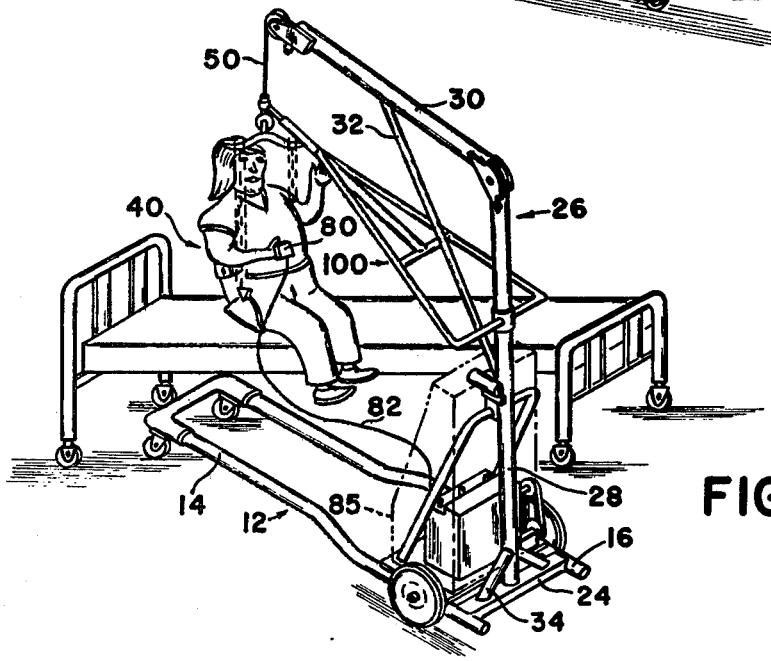

The invention will now be described with reference to the accompanying drawings wherein FIG. 1 is a side perspective view of the invalid transfer device and FIG. 2 is an illustration of the device being operated by an invalid.

The invalid transfer device 10 includes a base 12 with a front end 14 and a rear end 16. The front end 14 includes a pair of front wheels 18 and the rear end includes a pair of rear wheels 20. The front end defines a uniform width A extending to the rear end 16 which defines a larger uniform width B. The pair of front wheels 18 are attached to a plate or tube 22 at the front edge of the device 10 and are generally of the universal castor type. The pair of rear wheels 20 are larger than the pair of front wheels with both pair of wheels including non-scuff tires. The base 12 is made from a pair of tubular members joined at the front by the plate or tube 22 and joined at the rear by a plate or tube 24, see FIG. 2.

A support assembly 26 extends upwardly from the rear end of the base 12 and includes a vertical support 28, a boom member 30 and a connecting link 32. The boom member 30 forms an angle relative to a horizontal axis which is about 30°. The vertical support is fixedly secured to the plate or tube 24 with a pair of angular supports 34 reinforcing the fixation thereto. The boom member 30 is fixedly carried by a first pair of flanges 36 in spaced relation to the vertical support 28 for a purpose hereinafter defined. The connecting link 32 extends between the boom member 30 and the vertical support 28 to reinforce the fixed positions thereof in a 30° relationship.

In order to support an individual on the transfer device 10, a carrier assembly 40 is provided. The carrier assembly 40 comprises a seat 42, a backrest 44 and a bar 46 coupled to the backrest and seat via a pair of chains or ropes 48 or other suitable coupling. The bar 46 is coupled to a cable 50 to control the elevation of the carrier assembly 40 relative to the base 12. The cable extends from the carrier assembly 40 to an end pulley 52 attached to the end of the boom member 30 via a second pair of flanges 54. The boom member 30 is tubular with a bore therethrough for receiving the cable. The first pair of flanges 36 support an intermediate pulley 56 so that the cable 50 partially wraps around the pulley 56 to extend into a bore formed within the vertical support 28.

The pulleys 52 and 56 could be covered to enclose the cable within the support assembly. An aperture 58 formed at an intermediate height on the vertical support 28 receives a pulley 60 so that the cable 50 can wrap around the pulley 60. The pulley 60 forms a part of a winch which is operable to unwind or windup the cable around the pulley 60 or, in the alternative, the cable can partially wrap around the pulley 60 and extend to a winch separate from the pulley 60.

In order to operate the transfer device, a control unit 70 is attached to the base 12 at the rear end 16. The control unit includes a solenoid package 72, a battery 74, a motor package 76, a second motor 78, and a control head 80. The motor package 76 includes separate motors for each rear wheel. The control head 80 is connected via a flexible wire 82 with the solenoid package 72, which in turn is connected to the motor package 76, the second motor 78, and the battery 74 via suitable electrical leads. A cover 85, shown in phantom, is provided to enclose the control unit 70, except for the control head 80 and a part of the wire 82. The control head can be removed from the cover for hand operation by the individual when disposed in the carrier assembly 40. A platform 84 is secured to the wide rear end 16 of the base 12. The platform 84 carries the solenoid package 72, the battery 74 and the motor package 76. A bracket 86 is secured to the vertical support 28 adjacent the aperture 58. The pulley 60 and the second motor 78 are supported on the bracket 86. A pair of legs 88 and 90 extend diagonally from the bracket 86 to the platform 84 to reinforce the bracket 86 and also to further reinforce the vertical support 28. The motor package 76 cooperates with both rear wheels 20 via separate belts 92 (only one of which is shown) so that each wheel 20 can be operated separately. Consequently, the motor package 76 can alter the direction of the transfer device as well as move the transfer device forward and backward. The motor 78 is coupled to the pulley 60 to form a winch to control movement of the cable 50 and in turn control elevation of the carrier assembly 40.

To prevent the carrier assembly 40 from swinging away from a position directly over the front end, an anti-sway assembly 100 extends between the vertical support 28 and the carrier assembly 40. The anti-sway assembly 100 comprises a collar 102 fixed to the vertical support 28. A pair of lateral rods 104 and 106 extend outwardly from the collar 102, or in the alternative, the rods 104 and 106 could be fixed to the vertical support 28 itself. A pair of arms 108 and 110 connect with respective rods and extend in the direction of the front end to approach each other. A cross member 112 connects with both arms to form a spacing 114 with the arms and rods. The connecting link extends through the spacing. A cylinder 116 is secured to the cross member 112 and the ends of the pair of arms 108 and 110. A telescoping rod 118 is received within the cylinder 116 and is secured to the carrier assembly 40, or to the cable adjacent the carrier assembly 40. The pair of arms can pivot vertically relative to the pair of lateral rods 104 and 106 or, in the alternative, the pair of arms and rods can pivot vertically relative to the collar 102, provided the telescoping rod 118 remains secured to the carrier assembly when the latter is being moved up or down relative to the base 12.

As shown in FIG. 2, the invalid transfer device carries an individual substantially above the front end of the base 12 and the anti-sway assembly 100 retains the individual in this position at all times so that the device will not tip over. In this position the individual can readily lift himself above and directly over a bed for easy separation from the carrier assembly. The narrow front end is readily extended into small areas while the wide rear end with the weight of the control unit over the rear end provides stability for the transfer device. With the control unit carried at the rear end of the base, it is also possible for the individual to be lowered to a position directly over the floor. Consequently, the range of vertical movement for the individual is from the floor to the boom member 30.

A limit switch 120 is attached to the flanges 54. The limit switch 120 cooperates with the telescoping rod 118 when the latter contacts the switch to stop further elevation of the carrier assembly at its highest position.

In the alternative, the winch 60 could be replaced with a hydraulic device incorporated into the base and coupled to the cable, or, a hydraulic device could be substituted for the connecting link 32 to control movement of the carrier assembly. The cover 85 could also extend laterally at the base to enclose the latter.

I claim:

1. An invalid transfer device comprising a base with a front end having a narrower width than a rear end, said rear end including a pair of rear wheels having a larger diameter than a pair of front wheels coupled to said front end, said rear end carrying a control unit adapted to impart movement to said rear wheels, a vertical support extending upwardly from said rear end, a boom member extending outwardly from said vertical support in the direction of said front end, a connecting link coupled to said vertical support and said boom support to fixedly dispose said boom member relative to said vertical support, an anti-sway assembly extending outwardly from said vertical support in the direction of said front end, a carrier assembly adapted to carry the invalid above said front end, and a cable extending from said carrier assembly to said control unit, said control unit being operable to also control movement of said cable to lift the invalid relative to said base, and said anti-sway assembly operatively connected to said vertical support and said carrier assembly thus cooperating with said carrier assembly to substantially limit lateral movement of said carrier assembly away from a position above said front end, whereby the invalid remains substantially directly above said narrower front end width regardless of the elevation thereof relative to said base to stabilize the transfer device during operation.

2. The invalid transfer device of claim 1 in which said anti-sway assembly includes a telescoping rod secured to said carrier assembly.

3. The invalid transfer device of claim 1 in which said anti-sway assembly includes a pair of laterally extending rods secured to said vertical support and a pair of outwardly extending arms secured to said pair of rods, respectively, and approaching each other in the direction of said front end, said pair of rods cooperating with said pair of arms to define a spacing and said connecting link extending through said spacing to connect with said boom member and said vertical support.

4. The invalid transfer device of claim 1 in which said anti-sway assembly includes a pair of arms extending outwardly from said vertical support and approaching each other in the direction of said front end, and said pair of arms supporting a telescoping rod at a front end of said pair of arms, said telescoping rod being secured to said carrier assembly whereby said anti-sway assembly pivots in a vertical direction about said vertical support in response to vertical movement of said carrier assembly.

5. The invalid transfer device of claim 1 in which said boom member and said vertical support include longitudinally extending bores and said cable is movably disposed within said bores.

6. The invalid transfer device of claim 1 in which said control unit includes a motor package operatively coupled to said rear wheels and a second motor operatively coupled to said cable, said motor package being secured to said base at said rear end and said second motor being fixed relative to said vertical support substantially adjacent said connecting link.

7. The invalid transfer device of claim 1 in which a cover substantially encloses said control unit and said cover overlaps said rear end and extends from said base toward said connecting link.

8. The invalid transfer device of claim 1 in which said control unit includes at least one motor operatively coupled to said cable, said one motor being disposed adjacent said vertical support via a bracket secured thereto and a pair of legs extend from said bracket to said base to oppose movement of said vertical support relative to said base via said bracket.

9. The invalid transfer device of claim 1 in which said control unit occupies a predetermined length on said base which is less than one-half the total length of said base, whereby said control unit is remote from said carrier assembly when the latter is disposed adjacent to said base.

10. The invalid transfer device of claim 9 in which said base defines a wider width over the predetermined length than over the remaining length of said base.

11. An invalid transfer device for carrying an individual comprising a base with a pair of front wheels and a pair of rear wheels, a control unit disposed on said base adjacent the pair of rear wheels, a support assembly fixedly attached to said base adjacent the pair of rear wheels, a carrier assembly adapted to receive the individual therein, said carrier assembly being operatively connected to said control unit via a cable carried by said support assembly and an anti-sway assembly extending between said carrier assembly and said support assembly and operatively connected to said carrier assembly and said support assembly, said control unit being operable in response to an input by the individual when the latter is disposed therein to move the individual vertically relative to said base and said anti-sway assembly remaining operatively coupled to said carrier assembly and said support assembly to substantially prevent lateral movement of said carrier assembly in the absence of lateral movement of said base whereby the individual is stabilized on said device during the operation of said control unit.

12. The invalid transfer device of claim 11 in which said anti-sway assembly defines a spacing for receiving a portion of said support assembly.

13. The invalid transfer device of claim 11 in which said anti-sway assembly comprises a pair of rods extending laterally from said support assembly, a pair of arms coupled to said pair of rods respectively, and approaching each other in the direction of said pair of front wheels, a cross member connected to said pair of arms to define a spacing with said pair of rods and arms for receiving a portion of said support assembly, and a telescoping assembly coupled to said cross member and also coupled to ends of said pair of arms, said telescoping assembly being further coupled to said carrier assembly whereby said anti-sway assembly pivots relative to said support assembly when said carrier assembly is moved relative to said base and said anti-sway assembly substantially prevents lateral movement of said carrier assembly relative to said base in order to retain the individual directly over said base at all times.

14. The invalid transfer device of claim 11 in which said base defines a front end and a rear end, said rear end being wider than said front end whereby the weight of said control unit is carried substantially by said wide rear end, said narrow front end being readily adapted to fit into small spaces, and said anti-sway assembly defining a narrower width at the end coupled to said carrier assembly whereby said narrower end of said anti-sway assembly is also readily adapted to fit into small spaces.

* * * * *